US007045092B2

(12) United States Patent
Ogawa et al.

(10) Patent No.: US 7,045,092 B2
(45) Date of Patent: May 16, 2006

(54) METHOD FOR PRESS MOLDING RARE EARTH ALLOY POWDER AND METHOD FOR PRODUCING SINTERED OBJECT OF RARE EARTH ALLOY

(75) Inventors: Atsushi Ogawa, Osaka (JP); Shuhei Okumura, Osaka (JP)

(73) Assignee: Neomax Co., Ltd., Osaka (JP)

( * ) Notice: Subject to any disclaimer, the term of this patent is extended or adjusted under 35 U.S.C. 154(b) by 28 days.

(21) Appl. No.: 10/489,338

(22) PCT Filed: Apr. 4, 2003

(86) PCT No.: PCT/JP03/04370

§ 371 (c)(1),
(2), (4) Date: Mar. 12, 2004

(87) PCT Pub. No.: WO03/086687

PCT Pub. Date: Oct. 23, 2003

(65) Prior Publication Data

US 2004/0241033 A1 Dec. 2, 2004

(30) Foreign Application Priority Data

Apr. 12, 2002 (JP) ..... 2002-110950

(51) Int. Cl.
*B22F 3/14* (2006.01)

(52) U.S. Cl. ..... 419/38; 148/108

(58) Field of Classification Search ..... 419/38; 148/108

See application file for complete search history.

(56) References Cited

U.S. PATENT DOCUMENTS 4,600,555 A * 7/1986 Shimizu ..... 419/5
4,770,723 A 9/1988 Sagawa et al.
4,792,368 A 12/1988 Sagawa et al.
4,888,512 A * 12/1989 Shimizu ..... 310/156.43
4,990,306 A * 2/1991 Ohashi ..... 419/28

(Continued)

FOREIGN PATENT DOCUMENTS

JP 01-276604 11/1989
JP 05-234789 9/1993
JP 09-020953 1/1997

(Continued)

OTHER PUBLICATIONS

JP09-31229A, English translation of Example, 10 pages, Dec. 1997.*

*Primary Examiner*—Daniel Jenkins
(74) *Attorney, Agent, or Firm*—Nixon Peabody LLP; Jeffrey L. Costellia

(57) ABSTRACT

A perpendicular pressing/compacting method for a rare-earth alloy powder is provided to produce a sintered magnet with excellent magnetic properties. A method for pressing a rare-earth alloy powder by using a die is provided. The die is made of a non-magnetic material and has a die hole to define a cavity and a pair of yoke members provided on both sides of the cavity. The method includes the steps of: providing the rare-earth alloy powder; filling the cavity of the die with the rare-earth alloy powder; and compressing the rare-earth alloy powder, loaded in the cavity, between a pair of opposed press surfaces. A pulse magnetic field substantially perpendicular to a compressing direction is not applied until the apparent density of the rare-earth alloy powder in the cavity reaches a predetermined value, at least equal to 47% of the true density thereof, while the compressing step is being carried out.

7 Claims, 3 Drawing Sheets

U.S. PATENT DOCUMENTS 5,049,053 A * 9/1991 Tabaru ..... 425/3
5,167,915 A * 12/1992 Yamashita et al. ..... 419/12
5,186,766 A * 2/1993 Iriyama et al. ..... 148/301
5,250,255 A * 10/1993 Sagawa et al. ..... 419/39
5,383,978 A 1/1995 Yamamoto et al.
5,628,047 A * 5/1997 Hiroyoshi ..... 419/62
6,321,800 B1 11/2001 Ogawa et al.
6,767,505 B1 * 7/2004 Witherspoon et al. ..... 419/45

FOREIGN PATENT DOCUMENTS

JP 09-312230 12/1997
JP A9-312229 12/1997
JP 2000-323341 11/2000
JP 2002-047503 2/2002

* cited by examiner

METHOD FOR PRESS MOLDING RARE EARTH ALLOY POWDER AND METHOD FOR PRODUCING SINTERED OBJECT OF RARE EARTH ALLOY

TECHNICAL FIELD

The present invention relates to a method for compacting a rare-earth alloy powder and a method of making a sintered body of a rare-earth alloy.

BACKGROUND ART

A rare-earth alloy sintered magnet (permanent magnet) is normally produced by compacting a powder of a rare-earth alloy, sintering the resultant powder compact and then subjecting the sintered body to an aging treatment. Permanent magnets currently used extensively in various applications include rare-earth-cobalt based magnets and rare-earth-iron-boron based magnets. Among other things, the rare-earth-iron-boron based magnets (which will be referred to herein as "R—Fe—B based magnets", where R is one of the rare-earth elements including Y, Fe is iron and B is boron) are used more and more often in various electronic appliances. This is because an R—Fe—B based magnet exhibits a maximum energy product, which is higher than any of various other types of magnets, and yet is relatively inexpensive.

An R—Fe—B based sintered magnet includes a main phase consisting essentially of a tetragonal $R_2Fe_{14}B$ compound, an R-rich phase including Nd, for example, and a B-rich phase. In the R—Fe—B based sintered magnet, a portion of Fe may be replaced with a transition metal such as Co or Ni and a portion of boron (B) may be replaced with carbon (C). An R—Fe—B based sintered magnet, to which the present invention is applicable effectively, is described in U.S. Pat. Nos. 4,770,723 and 4,792,368, for example.

In the prior art, an R—Fe—B based alloy has been prepared as a material for such a magnet by an ingot casting process. In an ingot casting process, normally, rare-earth metal, electrolytic iron and ferroboron alloy as respective start materials are melted by an induction heating process, and then the melt obtained in this manner is cooled relatively slowly in a casting mold, thereby preparing an alloy ingot.

Recently, a rapid cooling process such as a strip casting process or a centrifugal casting process has attracted much attention in the art. In a rapid cooling process, a molten alloy is brought into contact with, and relatively rapidly cooled by, a single chill roller, a twin chill roller, a rotating disk or the inner surface of a rotating cylindrical casting mold, thereby making a solidified alloy, which is thinner than an alloy ingot, from the molten alloy. The solidified alloy prepared in this manner will be referred to herein as an "alloy flake". The alloy flake produced by such a rapid cooling process normally has a thickness of about 0.03 mm to about 10 mm. According to the rapid cooling process, the molten alloy starts to be solidified from its surface that has been in contact with the surface of the chill roller. That surface of the molten alloy will be referred to herein as a "roller contact surface". Thus, in the rapid cooling process, columnar crystals grow in the thickness direction from the roller contact surface. As a result, the rapidly solidified alloy, made by a strip casting process or any other rapid cooling process, has a structure including an $R_2Fe_{14}B$ crystalline phase and an R-rich phase. The $R_2Fe_{14}B$ crystalline phase usually has a minor-axis size of about 0.1 μm to about 100 μm and a major-axis size of about 5 μm to about 500 μm. On the other hand, the R-rich phase, which is a non-magnetic phase including a rare-earth element R at a relatively high concentration and having a thickness (corresponding to the width of the grain boundary) of about 10 μm or less, is dispersed on the grain boundary between the $R_2Fe_{14}B$ crystalline phases.

Compared to an alloy made by the conventional ingot casting process or die casting process (such an alloy will be referred to herein as an "ingot alloy"), the rapidly solidified alloy has been quenched in a shorter time (i.e., at a cooling rate of $10^{2}$° C./sec to $10^{4}$° C./sec). Accordingly, the rapidly solidified alloy has a finer structure and a smaller crystal grain size. In addition, in the rapidly solidified alloy, the grain boundary thereof has a greater area and the R-rich phase is dispersed broadly and thinly over the grain boundary. Thus, the rapidly solidified alloy also excels in the dispersiveness of the R-rich phase. Because the rapidly solidified alloy has the above-described advantageous features, a magnet with excellent magnetic properties can be made from the rapidly solidified alloy.

An alternative alloy preparation method called "Ca reduction process (or reduction/diffusion process)" is also known in the art. This process includes the processing and manufacturing steps of: adding metal calcium (Ca) and calcium chloride (CaCl) to either the mixture of at least one rare-earth oxide, iron powder, pure boron powder and at least one of ferroboron powder and boron oxide at a predetermined ratio or a mixture including an alloy powder or mixed oxide of these constituent elements at a predetermined ratio; subjecting the resultant mixture to a reduction/diffusion treatment within an inert atmosphere; diluting the reactant obtained to make a slurry; and then treating the slurry with water. In this manner, a solid of an R—Fe—B based alloy can be obtained.

It should be noted that any small block of a solid alloy will be referred to herein as an "alloy block". The "alloy block" may be any of various forms of solid alloys that include not only solidified alloys obtained by cooling a melt of a material alloy (e.g., an alloy ingot prepared by the conventional ingot casting process or an alloy flake prepared by a rapid cooling process such as a strip casting process) but also a solid alloy obtained by the Ca reduction process.

An alloy powder to be compacted is obtained by performing the processing steps of: coarsely pulverizing an alloy block in any of these forms by a hydrogen occlusion process, for example, and/or any of various mechanical milling processes (e.g., using a disk mill); and finely pulverizing the resultant coarse powder (with a mean particle size of 10 μm to 500 μm) by a dry milling process using a jet mill, for example.

The R—Fe—B based alloy powder to be compacted preferably has a mean particle size of 1.5 μm to about 6 μm to achieve sufficient magnetic properties. It should be noted that the "mean particle size" of a powder refers to herein a mass median diameter (MMD) unless stated otherwise. However, when a powder with such a small mean particle size is used, the resultant flowability, compactibility (including cavity fill density and compressibility) and productivity will be bad.

A powder made by a rapid cooling process such as a strip casting process (at a cooling rate of $10^{2}$° C./s to $10^{4}$° C./S), in particular, has a smaller mean particle size and a sharper particle size distribution that a powder made by an ingot casting process. Thus, the former powder is significantly inferior in flowability to the latter powder. Accordingly, the variation in the amount of the powder to be loaded into a cavity may exceed its allowable range or the fill density thereof within the cavity may become non-uniform. As a result, the variation in the mass or size of the resultant compact may exceed its allowable range or the compact may crack or chip. Furthermore, in that case, the magnetization directions of the compact cannot be sufficiently aligned by an aligning magnetic field, and the resultant sintered magnet exhibits low magnetic properties (such as its remanence).

According to the direction in which the aligning magnetic field is applied, the pressing and compacting methods to obtain compacts for magnets are roughly classifiable into the two types of: a parallel pressing method in which the aligning magnetic field is applied parallel to the pressing (or compressing) direction; and a perpendicular pressing method in which the aligning magnetic field is applied perpendicularly to the pressing direction.

Hereinafter, a pressing and compacting method for making a compact for an arched magnet will be described with reference to FIGS. 1(*a*) and 1(*b*). In FIGS. 1(*a*) and 1(*b*), the arrow B indicates the direction in which the aligning magnetic field is applied during the compaction process.

To improve the productivity and magnetic properties, the arched magnet 1*a* shown in FIG. 1(*a*) is obtained by once making and then cutting the sintered block 1*b* shown in FIG. 1(*b*). In the prior art, a compact to be processed into the sintered block 1*b* is obtained by the perpendicular pressing method. This is because the perpendicular pressing method makes it possible to press and compact the given powder without disturbing its magnetic field orientations. Thus, a magnet obtained by the perpendicular pressing method normally exhibits better magnetic properties than a magnet obtained by the parallel pressing method.

Meanwhile, yoke members are often provided in the vicinity of a die hole, which will define a cavity in a die made of a non-magnetic material, thereby concentrating the magnetic flux toward the inside of the cavity and increasing the strength of the aligning magnetic field. The yoke members are normally provided within 15 cm from the inner wall of the die hole as measured in the alignment direction. This arrangement is adopted because the higher the strength of the aligning magnetic fields within the cavity, the higher the remanence $B_r$ of the resultant magnet will be. If such a technique of increasing the in-cavity strength of the aligning magnetic field by using the yoke members is combined with the perpendicular pressing method described above, then a permanent magnet with even better properties can be produced.

In recent years, a fine powder with particle sizes (FSSS particle sizes) of 6 μm or less is often used to reduce the grain sizes of a sintered magnet. To align such fine powder particles, a stronger magnetic field than the conventional ones needs to be applied. However, if the in-cavity magnetic field strength is increased with the yoke members, the in-cavity magnetic field strength will have a non-uniform distribution, in which the magnetic field strength increases toward the end of the cavity in the alignment direction. Such a magnetic field strongly attracts the magnet powder in the cavity toward the yoke members. As a result, the apparent density of the magnet powder will be lower at the center of the cavity than at the end of the cavity. Particularly in the conventional static magnetic field pressing process, the aligning magnetic field starts to be applied at an early stage of the compacting and compressing process step (at which the powder still has so low a density as to move freely within the cavity), and therefore, the powder is easily distributed non-uniformly within the cavity. In that case, the powder that has been gathered toward the end of the cavity is pressed and shifted toward the center of the cavity as the upper punch is lowered to press the powder. In the meantime, the orientation directions are disturbed at both ends of the cavity. For these reasons, in the perpendicular pressing process to be carried out with the yoke members, the degree of alignment and density of the resultant powder compact easily become non-uniform, and the uniformity of the magnet performance tends to deteriorate excessively. Also, if the yoke members are provided in the vicinity of the cavity, the magnetic flux is concentrated but tends to be curved easily.

In order to overcome the problems described above, a primary object of the present invention is to provide a method for compacting a rare-earth alloy powder so as to produce a sintered magnet with uniform magnetic properties.

DISCLOSURE OF INVENTION

A rare-earth alloy powder compacting method according to the present invention is a method for compacting a rare-earth alloy powder by using a die. The die is made of a non-magnetic material and has a die hole and a pair of yoke members. The die hole defines a cavity, and the yoke members are provided on right- and left-hand sides of the die hole. The method includes the steps of: providing the rare-earth alloy powder; filling the cavity of the die with the rare-earth alloy powder; and compressing the rare-earth alloy powder, which has been loaded into the cavity, between a pair of press surfaces that are opposed to each other. A pulse magnetic field, which is substantially perpendicular to a compressing direction, is not applied until the apparent density of the rare-earth alloy powder in the cavity reaches a predetermined value, which is at least equal to 47% of the true density thereof, while the compressing step is being carried out.

The method preferably further includes the step of generating vibration in the rare-earth alloy powder while the compressing step is being carried out and before the pulse magnetic field starts to be applied.

In one preferred embodiment, the predetermined value is defined at 3.55 g/cm$^3$ or more.

In another preferred embodiment, the pulse magnetic field is an alternating attenuating field.

In another preferred embodiment, the pulse magnetic field is an inverse pulse magnetic field.

In another preferred embodiment, the vibration is transmitted from at least one of the two press surfaces.

In another preferred embodiment, the rare-earth alloy powder is made by a rapid cooling process.

An inventive method of making a sintered body of a rare-earth alloy includes the steps of: making a compact of the rare-earth alloy powder by one of the methods described above; and sintering the compact.

Figure 1A:
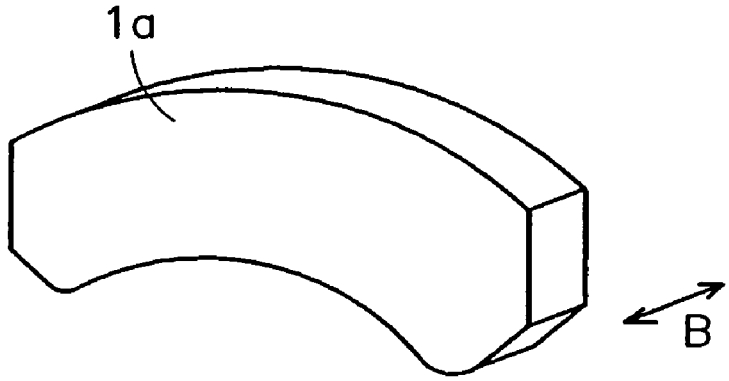
FIG. 1(*a*) is a schematic representation illustrating an arched magnet, and FIG. 1(*b*) is a schematic representation of a sintered block to be processed into the arched magnet.

4(*b*) schematically illustrates the state of powder particles in which no vibration has been generated yet.

BEST MODE FOR CARRYING OUT THE INVENTION

According to the present invention, a magnet powder is compressed and compacted with a die that is made of a non-magnetic material. The die for use in the present invention has a die hole to define a cavity and a plurality of yoke members provided on right- and left-hand sides of the die hole.

The present inventors discovered and confirmed via experiments that if a pulse magnetic field was applied perpendicularly to the pressing direction for alignment purposes, a compact with a high degree of alignment could be obtained at a good yield by delaying the application of such a pulse magnetic field until the apparent density of the alloy powder (which will also be referred to herein as a "pressed powder density (or green density)") reached a predetermined value.

According to the results of experiments the present inventors carried out, if the pulse magnetic field is applied while the powder being pressed still has a relatively low density, there is a plenty of space around the respective powder particles, a relatively weak force is applied to bring the powder particles into contact with each other, and the powder particles are easily aligned with the direction of the magnetic field applied. In this case, the powder in the die hole is attracted toward the yoke members. As a result, a phenomenon in which the density becomes higher at the end than at the center is also observed. Thereafter, the powder under compaction is further pressed and increases its density gradually. Then, the powder flows to disturb the orientation directions. Consequently, the powder particles of the resultant green compact will have a decreased degree of alignment.

To overcome such a problem, according to the present invention, the pulse magnetic field is not applied until the density of the powder being pressed reaches a predetermined value, which is at least equal to 47% of the true density thereof. By delaying the application of the pulse magnetic field until the pressed powder density reaches a certain level, the powder will not flow so easily and the orientation directions thereof will not be disturbed so much during the subsequent compressing and compacting process step.

On the other hand, if the powder being pressed has an excessively high density when the pulse magnetic field is applied, there will be left too narrow a space around the respective powder particles, and the powder particles will contact with each other too strongly, to allow the powder particles to change their directions even under the pulse magnetic field applied. In this manner, if the pressed powder density increases so much as to exceed a predetermined value, it will be difficult to obtain a magnet with excellent magnetic properties even with an intense pulse magnetic field applied. For that reason, when the pulse magnetic field starts to be applied, the density of the powder being pressed is preferably at most 53% of the true density thereof.

It should be noted that even at the same pressed powder density, the frictional drag between the alloy powder particles can still be reduced by generating vibration therein. Accordingly, the aligning magnetic field is preferably applied while the alloy powder is subjected to vibration. If the alloy powder is vibrated during the compressing/compacting process step, then the powder particles can be sufficiently aligned with the applied magnetic field even after its pressed powder density has reached a rather high value.

Furthermore, even at the same pressed powder density, the frictional drag between the alloy powder particles can still be reduced by applying an alternating attenuating field thereto. In that case, the powder particles can be sufficiently aligned with the applied magnetic field even after its pressed powder density has reached a rather high value.

EMBODIMENTS

Hereinafter, preferred embodiments of a method of making a rare-earth alloy sintered body according to the present invention will be described with reference to the accompanying drawings.

First, a rare-earth alloy powder for use in this preferred embodiment will be described. Various rare-earth alloy powders may be used in the present invention. Among other things, an R—Fe—B based rare-earth alloy is particularly preferred. Compositions and manufacturing processes of preferred R—Fe—B based rare-earth alloys are described in U.S. Pat. Nos. 4,770,723 and 4,792,368, for example.

In an R—Fe—B based rare-earth alloy with a typical composition, Nd or Pr is often used as R, a portion of Fe may be replaced with a transition element (such as Co), and a portion of B may be replaced with C.

In this preferred embodiment, a powder with a mean particle size of 1.5 μm to 6 μm, obtained by pulverizing an Nd—Fe—B based solidified alloy (with a density 7.5 g/cm$^3$) that has been prepared by a rapid cooling process, is preferably used. The surface of the alloy powder is preferably coated with a lubricant such as zinc stearate. More specifically, the alloy powder can be obtained in the following manner. First, an alloy, having a composition including 30 mass % of Nd, 1.0 mass % of B, 1.2 mass % of Dy, 0.2 mass % of Al, 0.9 mass % of Co and Fe and inevitable impurities as the balance, is melted by an induction melting process to obtain a molten alloy. The molten alloy is solidified by the strip casting process, described in U.S. Pat. No. 5,383,978, thereby obtaining an alloy ingot. The resultant alloy ingot is coarsely pulverized by a hydrogen occlusion process and then finely pulverized with a jet mill, thereby obtaining an alloy powder with a mean particle size of 3.5 μm (including 0.3 mass % of zinc stearate as a lubricant).

Next, this powder is compressed and compacted with a press machine. Hereinafter, a configuration for a press machine to be preferably used in this preferred embodiment will be described with reference to FIG. 2.

Figure 2:
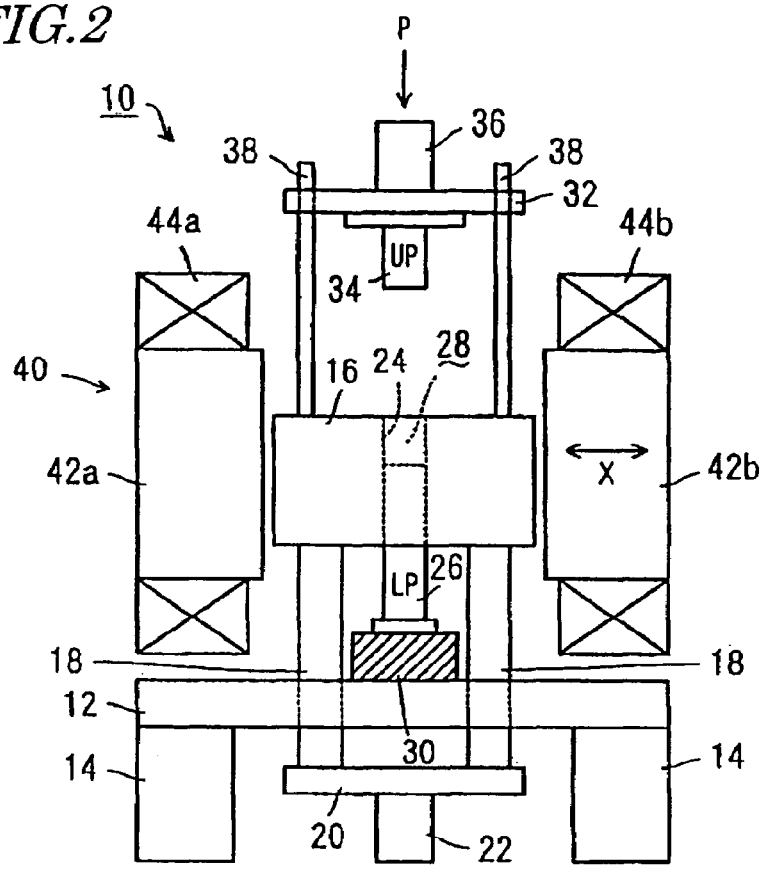
FIG. 2 is a schematic representation illustrating a configuration for a press machine that can be used effectively in a compaction process according to a preferred embodiment of the present invention.

The pressing/compacting machine 10 shown in FIG. 2 includes a base plate 12, which is supported by a plurality of legs 14. A die 16 is provided over the base plate 12. The lower surface of the die 16 is connected to a coupling plate 20 by way of a pair of guide posts 18 extending through the base plate 12. The coupling plate 20 is connected to a lower hydraulic cylinder (not shown) via a cylinder rod 22. Thus, the die 16 can be moved vertically by the lower hydraulic cylinder.

A die hole (through hole) 24 is provided approximately at the center of the die 16 so as to extend perpendicularly through the die 16. A lower punch 26 is inserted upward into the die hole 24, thereby defining a cavity 28 inside of the die hole 24.

Figure 3:
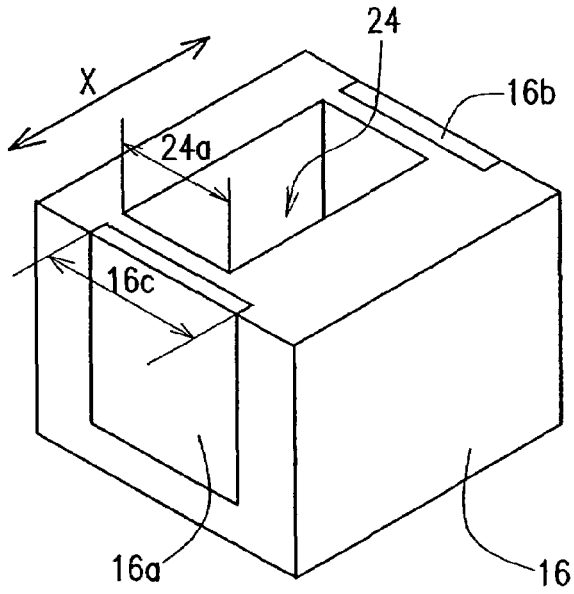
FIG. 3 is a perspective view illustrating an exemplary configuration for a die for use in the compaction process in the preferred embodiment of the present invention.

As shown in FIG. 3, the die 16 includes a pair of yoke members 16*a* and 16*b*, which are opposed to each other so as to sandwich the die hole 24 between them in the direction in which the aligning magnetic field is applied (i.e., the X direction). The yoke members 16*a* and 16*b* are made of a material with a high permeability such as carbon steel (e.g., Permendur). To increase the productivity, the heat to be generated by an eddy current should be minimized and yet the orientation directions need to be aligned during the pressing process. To achieve these purposes at the same time, a material with a low saturation flux density Bs is preferably used. On the other hand, the die 16 is made of a non-magnetic material. The side surfaces of the die 16 have recesses to receive the yoke members 16*a* and 16*b* therein. As used herein, the "non-magnetic material" refers to a material with a saturation magnetization of 0.2 tesla (T) or less.

As also shown in FIG. 3, the length 16*c* of the yokes is defined to be at least equal to, or greater than (up to 120% on, the length 24*a* of the cavity between them. By adopting such a size relationship, the directions of magnetic lines of flux can be further aligned.

Figure 1B:
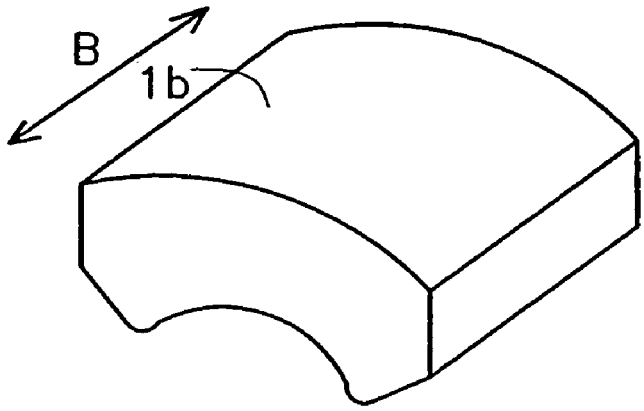

Look at FIG. 1 again.

The lower punch 26 is provided on a vibrator 30, which is in turn placed on the die plate 12. Thus, the lower punch 26 is fixed onto the base plate 12 but may be vibrated by the vibrator 30 vertically, i.e., parallel to the pressing direction. As the vibrator 30, a vibrator produced by Daiichi Corp. may be used, for example.

An upper punch plate 32 is provided over the die 16. An upper punch 34 is provided on the lower surface of the upper punch plate 32 so as to be insertable into the cavity 28. A cylinder rod 36 is provided on the upper surface of the upper punch plate 32. An upper hydraulic cylinder (not shown) is connected to the cylinder road 36. A pair of guide posts 38 extending perpendicularly is inserted into the upper punch plate 32 around the right and left edges thereof, and their bottoms are connected to the upper surface of the die 16.

The upper punch plate 32 can be shifted vertically by the upper hydraulic cylinder while being guided by the guide posts 38. As a result, the upper punch 34 can also be shifted vertically and can be inserted into the cavity 28.

In the pressing/compacting process, the given powder is compressed by the lower and upper punches 26 and 34 within the cavity 28, thereby making a compact.

A magnetic field generator 40 is provided near the die 16 so as to align the orientation directions of the powder in the cavity 28. The magnetic field generator 40 includes a pair of yokes 42*a* and 42*b*, which are opposed to each other so as to sandwich the die 16 between them. As the yoke members 16*a* and 16*b* of the die 16, the yokes 42*a* and 42*b* are also made of a material with high permeability such as carbon steel. Coils 44*a* and 44*b* are wound around the yokes 42*a* and 42*b*, respectively. When currents are supplied through these coils, a pulse magnetic field is generated in the direction indicated by the arrow X, thereby aligning the orientation directions of the powder in the cavity 28. As used herein, the "pulse magnetic field" refers to a magnetic field of which the strength is 90% or more of its peak value for at most 0.2 second.

In this press machine 10, the pressing direction is perpendicular to the direction of the aligning magnetic field, and the applied magnetic field may have a strength of 3 T at the center of the cavity, for example.

The press machine 10 shown in FIG. 2 is withdrawal type press machine in which the die 16 is supposed to be moved up and down. Alternatively, a double-action-type press machine, in which both the upper and lower punches 34 and 26 are supposed to be moved, may also be used.

As shown in FIG. 2, the cavity 24 is defined by the die hole 28 of the die 16 and the upper surface (i.e., press surface) of the lower punch 26, and then is filled with the alloy powder described above.

The alloy powder may be loaded by any of various known methods. For example, a method of filling the cavity with the alloy powder in a feeder box by utilizing the weight of the alloy powder itself is simple and preferred. According to this method, the cavity can be filled with the alloy powder at an appropriate apparent density (of 1.7 g/cm$^3$ to 2.5 g/cm$^3$, for example). Also, after the cavity has been filled with the alloy powder, a slicing bar may be slid along the surface of the die 16 such that the amount of the alloy powder in the cavity 28 can be kept substantially constant. The powder feeding method disclosed in Japanese Laid-Open Publication No. 2001-9595 may be used, for example.

Next, by moving the upper punch 34 and/or the lower punch 26 up and down, the alloy powder in the cavity 28 is uniaxially pressed. Typically, the upper punch 34 is moved downward. Alternatively, the upper punch 34 and lower punch 26 may be simultaneously moved downward and upward, respectively.

In this preferred embodiment, while this uniaxial pressing process is being carried out, the alloy powder in the cavity 28 is subjected to (mechanical) vibration. By vibrating the alloy powder, the bridge structure that links the powder particles together is broken, thereby allowing the powder particles to move easily. Hereinafter, it will be described with reference to FIGS. 4(*a*) and 4(*b*) exactly how that bridge structure is broken by the vibration generated.

Figure 4:
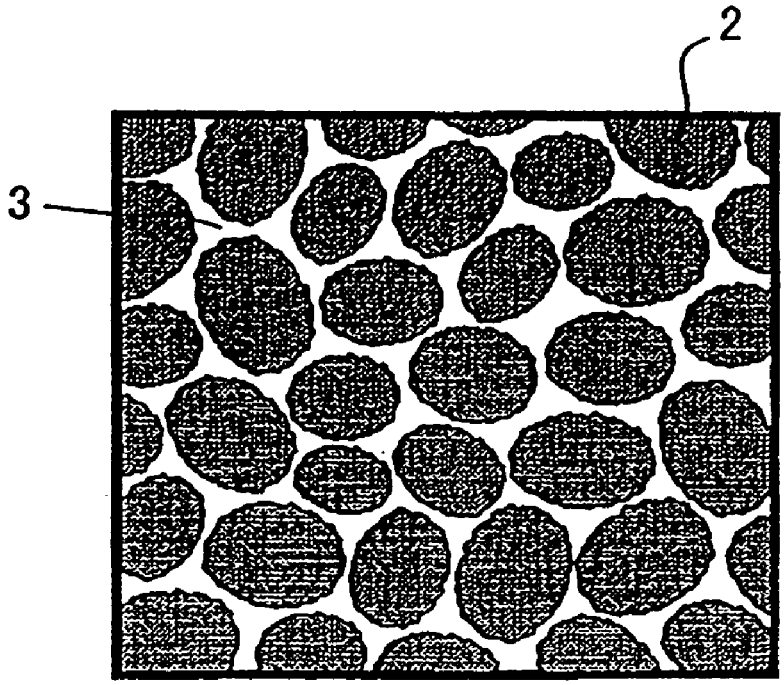
FIG. 4(*a*) schematically illustrates the state of powder particles in which vibration has already been generated in the compaction process of the present invention, while FIG.
Figure 4:
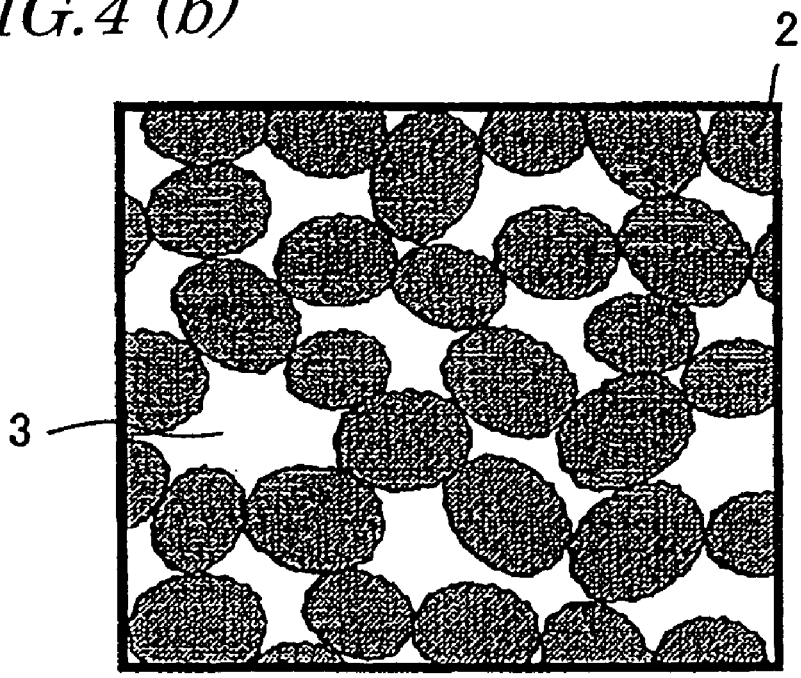

As shown in FIG. 4(*b*), the alloy powder that has just been loaded into the cavity defines the bridge structure by allowing the particles 2 to contact with each other. Accordingly, the total volume of the spaces 3 between the particles 2 is relatively large but the spaces 3 are distributed non-uniformly. However, by subjecting the alloy powder in such a state to vibration, the bridge structure that has been formed by the contacting particles 2 is broken, and the non-uniformly distributed spaces 3 are now arranged uniformly as shown in FIG. 4(*a*). As a result, the total volume of the spaces 3 between the particles 2 decreases and the powder has an increased apparent density. However, since the spaces 3 are distributed substantially uniformly around the respective particles 2, the particles 2 can now move (i.e., rotate due to the alignment of orientation directions under the magnetic field) easily. Naturally, the density distribution of the alloy powder in the cavity also becomes uniform. Furthermore, even though the apparent density remains the same, the alloy powder is movable, and can be aligned with the aligning magnetic field, more easily with the vibration generated than without any vibration generated. This is believed to be because when the alloy powder is subjected to the vibration, the friction between the alloy powder particles changes from static friction into kinetic friction to decrease the frictional drag between them.

The vibration is preferably transmitted from the press surface(s) (i.e., the bottom of the upper punch and/or the top of the lower punch). In particular, by adopting a configuration in which the lower punch is vibrated mechanically, kinetic energy can be applied to the alloy powder efficiently and the structure of the press machine can be simplified.

The vibration preferably has an amplitude of 0.001 mm to 0.2 mm. The reason is as follows. Specifically, if the vibration has an amplitude of less than 0.001 mm, the bridge structure of the powder particles could not be broken sufficiently. However, if the amplitude exceeds 0.2 mm, then the powder particles will easily eat into the gap between the die and the lower punch, thus possibly hurting the die or the lower punch.

The vibration preferably has a frequency of 5 Hz to 1,000 Hz. The reasons are as follows. Specifically, if the vibration has a frequency of less than 5 Hz, then the bridge structure of the powder particles could not be broken sufficiently. However, if the vibration has a frequency exceeding 1,000 Hz, then the vibration generator will be too expensive to use the press machine actually.

When the pulse magnetic field starts to be applied to the alloy powder in the cavity, the powder is subjected to the vibration to achieve the state shown in FIG. 4(*b*). The vibration may be either stopped when the apparent density reaches the predetermined value as a result of the compression or continued even after the apparent density has reached the predetermined value.

To apply the pulse magnetic field just as intended while the pressed powder density falls within a predetermined range, the strokes of the upper punch and/or lower punch are preferably controlled such that the upper punch and/or lower punch once stop moving when a pressed powder with a predetermined density is obtained. While the upper and/or lower punch(es) are/is temporarily stopped, the aligning magnetic field may be applied and then the pressing process may be resumed to obtain a green compact in the end.

In this preferred embodiment, a pulse magnetic field (with a maximum field strength of 2 T to 5 T and a pulse width of 0.05 second) is applied and a vibration (with an amplitude of 0.01 mm to 0.03 mm and a frequency of 40 Hz to 80 Hz) is transmitted upward from the lower punch in order to align the orientation directions under the magnetic field. The vibration is preferably generated after the alloy powder has been loaded such that the cavity is defined by lowering the upper punch and before the powder being pressed has a density of 3.55 g/cm$^3$ to 3.90 g/cm$^3$. Also, the pulse magnetic field is preferably applied with the upper and lower punches stopped and with the vibration generated therein. Thereafter, in this preferred embodiment, the powder is pressed again such that the resultant green compact has a density of 4.0 g/cm$^3$ to 4.4 g/cm$^3$. The green compact may have dimensions of 60 mm×40 mm×20 mm, for example.

This green compact is sintered at about 1,000° C. to about 1,200° C. for 2 to 6 hours within an Ar atmosphere, for example. Thereafter, the resultant sintered compact is subjected to an aging treatment at about 400° C. to about 600° C. for 1 to 3 hours within an Ar atmosphere again, thereby obtaining a sintered body.

If the pulse magnetic field application timing is defined as a point in time when the density of the powder being pressed reaches a predetermined value of 3.55 g/cm$^3$ or more, then the generation of the vibration further increases the remanence. The pulse magnetic field application timing is preferably defined as a point in time when the pressed powder density reaches a predetermined value of 3.6 g/cm$^3$ or more. Sufficient effects are achievable even if the timing is associated with a pressed powder density of 3.78 g/cm$^3$ or more. However, the present inventors discovered that if the pulse magnetic field was applied after the pressed powder density exceeded 4.0 g/cm$^3$, then the remanence tended to decrease and the powder particles could not be aligned sufficiently. In view of these considerations, the pulse magnetic field is preferably applied while the powder being pressed has a density of 3.55 g/cm$^3$ to 3.9 g/cm$^3$. The lower limit of a more preferable density range is 3.6 g/cm$^3$, and the lower limit of an even more preferable density range is 3.7 g/cm$^3$.

Optionally, the pulse magnetic field may be applied a number of times to the powder being pressed with a density falling within any of these preferred ranges. Also, not only the pulse magnetic field but also a static magnetic field may be applied thereto.

According to this preferred embodiment, even if the magnetic field distribution within the cavity has become non-uniform due to the presence of the yoke members in the vicinity of the die hole, the degree of alignment can still be made uniform by controlling the pulse magnetic field application timing.

The same statement also applies to a situation where alternating attenuating pulses are applied. That is to say, the magnetic powder can be rotated, and the bridge structure of the alloy powder in the cavity can be broken, by the magnetic field with alternating directions. The bridge structure can also be broken by applying inverse pulses, not just the alternating attenuating pulses.

EXAMPLE

As in the preferred embodiments described above, a sintered body was made. Specifically, the sintered body was prepared under the following conditions:

- Material powder: a powder obtained by coarsely pulverizing an alloy having a composition including 30 mass % of Nd, 1.0 mass % of B, 1.2 mass % of Dy, 0.2 mass % of Al, 0.9 mass % of Co and Fe and inevitable impurities as the balance by a hydrogen pulverization process and then finely pulverizing the coarse powder with a jet mill;
- Compacting method: the powder was compressed and compacted by using the machine shown in FIG. 2 and with a pulse magnetic field having a peak strength of 3 T (and a pulse width of 0.05 second) applied as an aligning magnetic field;
- Aligning magnetic field started to be applied at: a density of 3.6 g/cm$^3$;
- Shape and dimensions of the compact: 60 mm×40 mm×20 mm; and
- Sintering process: was carried out at about 1,050° C. for 5.5 hours within an Ar atmosphere.

Thereafter, the sintered compact was subjected to an aging treatment at about 500° C. for 3 hours within an Ar atmosphere.

COMPARATIVE EXAMPLE

A sintered body was made as in the example of the present invention described above except that a static magnetic field of 1 T was applied as the aligning magnetic field.

The surface flux densities were measured at two points (i.e., at the center and at the end) in the direction in which the aligning magnetic field was applied. As a result, the difference in surface flux density was 10% in the example of the present invention but 4% in the comparative example.

In the preferred embodiments described above, a strip-cast Nd—Fe—B based alloy powder, which exhibits excellent magnetic properties but has particularly low flowability, is used. However, the effects of the present invention are naturally achievable even by using a rare-earth alloy powder made by any other method.

Also, in the preferred embodiments described above, the alloy powder is used after having been subjected to a surface treatment with a lubricant. Alternatively, the alloy powder may be subjected to any other surface treatment. Furthermore, a granulated powder may also be used. The granulated powder may be crushed under vibration and/or an aligning magnetic field, and therefore, a sufficient degree of alignment is achievable.

INDUSTRIAL APPLICABILITY

The present invention provides a perpendicular pressing and compacting method for a rare-earth alloy powder to produce a sintered magnet with excellent magnetic properties. A compact obtained by the pressing and compacting method of the present invention has a sufficiently high green density. In addition, the alloy particles thereof are aligned to a rather high degree. Thus, a sintered magnet with excellent magnetic properties can be obtained. According to the present invention, the productivity of sintered magnets in an unusual shape can be increased significantly.

The invention claimed is:

1. A method for pressing and compacting a rare-earth alloy powder by using a die, the die being made of a non-magnetic material and having a die hole and a pair of yoke members, the die hole defining a cavity, the yoke members being provided on right- and left-hand sides of the die hole, the method comprising the steps of:

providing the rare-earth alloy powder;

filling the cavity of the die with the rare-earth alloy powder;

generating vibration in the rare-earth alloy powder; and compressing the rare-earth alloy powder, which has been loaded into the cavity, between a pair of press surfaces that are opposed to each other, wherein a pulse magnetic field, which is substantially perpendicular to a compressing direction, is not applied until the apparent density of the rare-earth alloy powder in the cavity reaches a predetermined value, which is at least equal to 47% of the true density thereof, while the compressing step is being carried out, and the step of generating vibration in the rare-earth alloy powder is performed while the compressing step is being carried out and before the pulse magnetic field starts to be applied.

2. The method of claim 1, wherein the predetermined value is defined at 3.55 g/cm$^3$ or more.

3. The method of claim 1, wherein the pulse magnetic field is an alternating attenuating field.

4. The method of claim 1, wherein the pulse magnetic field is an inverse pulse magnetic field.

5. The method of claim 1, wherein the vibration is transmitted from at least one of the two press surfaces.

6. The method of claim 1, wherein the rare-earth alloy powder is made by a rapid cooling process.

7. A method of making a sintered body of a rare-earth alloy, the method comprising the steps of:

making a compact of the rare-earth alloy powder by the method of claim 1; and sintering the compact.

* * * * *